US007185625B1

(12) United States Patent
Guan et al.

(10) Patent No.: US 7,185,625 B1
(45) Date of Patent: Mar. 6, 2007

(54) ROTARY PISTON POWER SYSTEM

(76) Inventors: Shilai Guan, 94-3438 Garrard Road, Whitby, Ontario (CA) L1R 2C4; Yanyan Zhang, 94-3438 Garrard Road, Whitby, Ontario (CA) L1R 2C4

( * ) Notice: Subject to any disclaimer, the term of this patent is extended or adjusted under 35 U.S.C. 154(b) by 54 days.

(21) Appl. No.: 11/211,647

(22) Filed: Aug. 26, 2005

(51) Int. Cl.

| | |
|---|---|
| ***F02B 53/00*** | (2006.01) |
| ***F02B 53/04*** | (2006.01) |
| ***F01C 1/00*** | (2006.01) |
| ***F04C 18/00*** | (2006.01) |
| *F04C 2/00* | (2006.01) |

(52) U.S. Cl. ..... 123/246; 123/245; 123/204; 123/231; 123/228; 418/227; 418/165; 418/170; 418/168; 418/169; 418/167

(58) Field of Classification Search ..... 123/245–246, 123/232, 231, 228–229; 418/165, 167, 169, 418/170, 227

See application file for complete search history.

(56) References Cited

U.S. PATENT DOCUMENTS

| | | | | |
|---|---|---|---|---|
| 949,605 | A * | 2/1910 | Taylor | 418/165 |
| 1,234,262 | A * | 7/1917 | Bateman | 418/165 |
| 1,294,771 | A * | 2/1919 | Conklin | 418/165 |
| 1,753,476 | A * | 4/1930 | Richer | 418/168 |
| 2,068,570 | A * | 1/1937 | Ross | 418/144 |
| 2,136,066 | A * | 11/1938 | Walters et al. | 418/227 |
| 2,454,006 | A * | 11/1948 | Plummer | 418/227 |
| 2,495,760 | A * | 1/1950 | Pinkel | 418/165 |
| 3,096,569 | A * | 7/1963 | Cook et al. | 418/152 |
| 3,330,215 | A * | 7/1967 | Seiji | 418/227 |
| 3,606,600 | A * | 9/1971 | Pollman | 418/61.1 |
| 3,758,244 | A * | 9/1973 | Gerber | 418/169 |
| 3,779,215 | A | 12/1973 | Sabet | |
| 3,797,237 | A | 3/1974 | Kamiya | |
| 3,809,026 | A | 5/1974 | Synder | |
| 3,810,721 | A * | 5/1974 | Eyer | 418/169 |
| 3,843,284 | A | 10/1974 | Spinnett | |
| 3,850,150 | A * | 11/1974 | Plevyak | 123/246 |
| 4,009,691 | A | 3/1977 | Sabet | |
| 4,728,273 | A | 3/1988 | Linder | |
| 4,741,308 | A * | 5/1988 | Ballinger | 123/231 |
| 4,883,414 | A | 11/1989 | Schabert | |
| 4,968,234 | A | 11/1990 | Densch | |
| 5,220,893 | A | 6/1993 | Costa | |

(Continued)

FOREIGN PATENT DOCUMENTS

| | | |
|---|---|---|
| DE | 4439063 | 6/1995 |

*Primary Examiner*—Thai-Ba Trieu
(74) *Attorney, Agent, or Firm*—Richard C. Litman

(57) ABSTRACT

The rotary piston power system includes a housing having a drum and a cover rotatably mounted on the drum. The drum has high pressure and low pressure ports defined in its peripheral wall and a central separator wall having arcuate end faces and a pair of semicylindrical recesses defined in opposing sidewalls. A pair of pistons are rotatably mounted on axles on opposite sides of the separator wall and fit closely between the separator wall and the peripheral wall. Each piston has a plurality of radially disposed cylindrical recesses defining slots in the piston's peripheral wall. The cover has a plurality of radially disposed vanes extending into the drum defining a number of cylinders or chambers double the number of recesses defined in a single piston. An input/output shaft extends from the opposite side of the cover for coupling to a prime mover or to a load.

18 Claims, 3 Drawing Sheets

U.S. PATENT DOCUMENTS

| | | | | |
|---|---|---|---|---|
| 5,341,782 | A | 8/1994 | McCall | |
| 5,357,923 | A | 10/1994 | Osterburg | |
| 5,373,819 | A | 12/1994 | Linder | |
| 5,685,269 | A * | 11/1997 | Wittry | 123/245 |
| 6,119,649 | A | 9/2000 | Raab | |
| 6,401,686 | B1 | 6/2002 | Prueitt | |
| 6,461,127 | B1 | 10/2002 | Kim | |
| 6,532,860 | B2 | 3/2003 | Ota | |
| 6,860,724 | B2 | 3/2005 | Cho | |
| 7,111,606 | B2 * | 9/2006 | Klassen | 123/246 |
| 2004/0050356 | A1 | 3/2004 | Stotler | |
| 2004/0163532 | A1 | 8/2004 | Harcourt | |
| 2004/0255898 | A1 | 12/2004 | Demafiles | |
| 2005/0000483 | A1 | 1/2005 | Okulov | |
| 2006/0032476 | A1 * | 2/2006 | Bowley | 123/228 |

* cited by examiner

ROTARY PISTON POWER SYSTEM

BACKGROUND OF THE INVENTION

1. Field of the Invention

The present invention relates to power systems for driving engines and compressors, and particularly to a rotary piston power system having rotating pistons disposed within a housing that includes a rotating cover either driving rotation of the pistons (in the case of a compressor) or driven by the input of pressurized fluid into the system (in the case of an engine).

2. Description of the Related Art

Reciprocating power plants generally rely on complex mechanical interconnections with a multitude of moving parts subject to mechanical failure. As a result, rotary engines and compressors have been suggested as an alternative that has fewer moving parts than a reciprocating engine, produces less vibration, and is capable of producing more horsepower than a reciprocating power system of the same or comparable size. However, even conventional rotary piston power systems, and particularly rotary engines, typically rely on a complex arrangement of a multiplicity of rotating and engaging parts, thus having poor energy efficiency due to frictional losses and losses through mechanical vibration, compared to a simple reciprocating power system having the same power output and having a minimum of moving parts. Conventional rotary power systems typically have an eccentric shaft and/or pistons that do not have a smooth curvature, rendering the parts expensive to manufacture, prone to mechanical failure, and difficult to maintain a proper seal in the chamber(s).

Thus, a rotary piston power system solving the aforementioned problems is desired.

SUMMARY OF THE INVENTION

The rotary piston power system is a dual-rotary piston device. In some embodiments, the system may be configured as a fluid-driven engine, while in other embodiments the device may be configured as a fluid compressor. The rotary piston power system includes a housing having a drum and a cover rotatably mounted on the drum. The drum has high pressure and low pressure ports defined in its peripheral wall and a central separator wall having arcuate end faces and a pair of semicylindrical recesses defined in opposing sidewalls. A pair of pistons are rotatably mounted on axles on opposite sides of the separator wall and fit closely between the separator wall and the peripheral wall. Each piston has a plurality of radially disposed cylindrical recesses defining slots in the piston's peripheral wall. The cover has a plurality of radially disposed vanes extending into the drum defining a number of cylinders or chambers double the number of recesses defined in a single piston. An input/output shaft extends from the opposite side of the cover for coupling to a prime mover or to a load.

When configured as a compressor, air or other compressible fluid at atmospheric or low pressure enters the drum through the low pressure ports. A prime mover coupled to the input shaft rotates the cover, the vanes alternately engaging the pistons and causing the pistons to rotate, compressing the fluid as the volume of the cylinders or chambers is reduced when rotating past the pistons, the compressed fluid being discharged through the high pressure ports.

When configured as an engine, fluids introduced through the high pressure ports impact the vanes, causing the cover to rotate. Output is coupled from the output shaft to the load.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
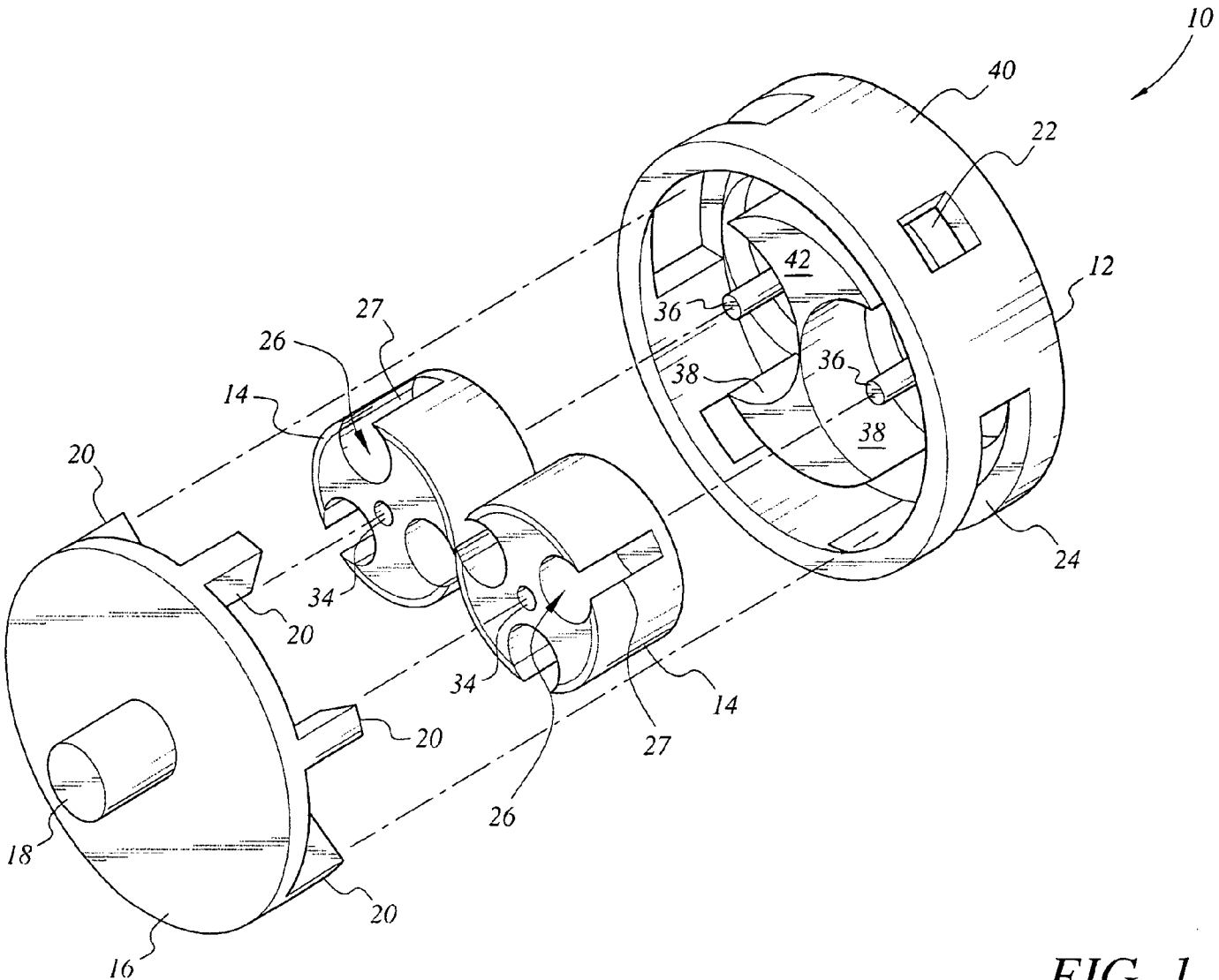
FIG. 1 is an exploded view of a rotary piston power system according to the present invention.
Figure 2A:
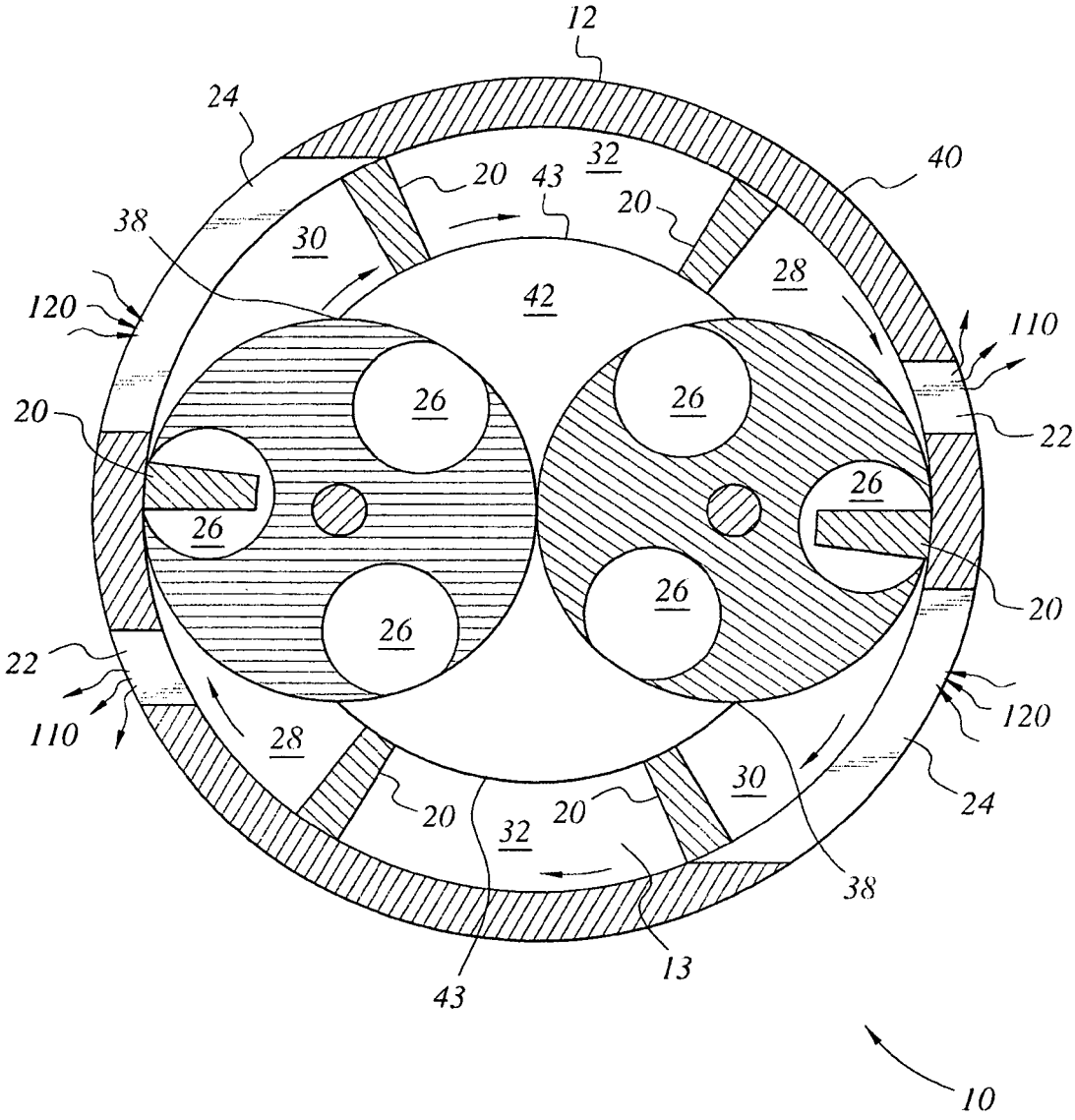
FIG. 2A is a transverse section view through the housing of a first embodiment of the rotary piston power system according to the present invention configured to act as a compressor.
Figure 2B:
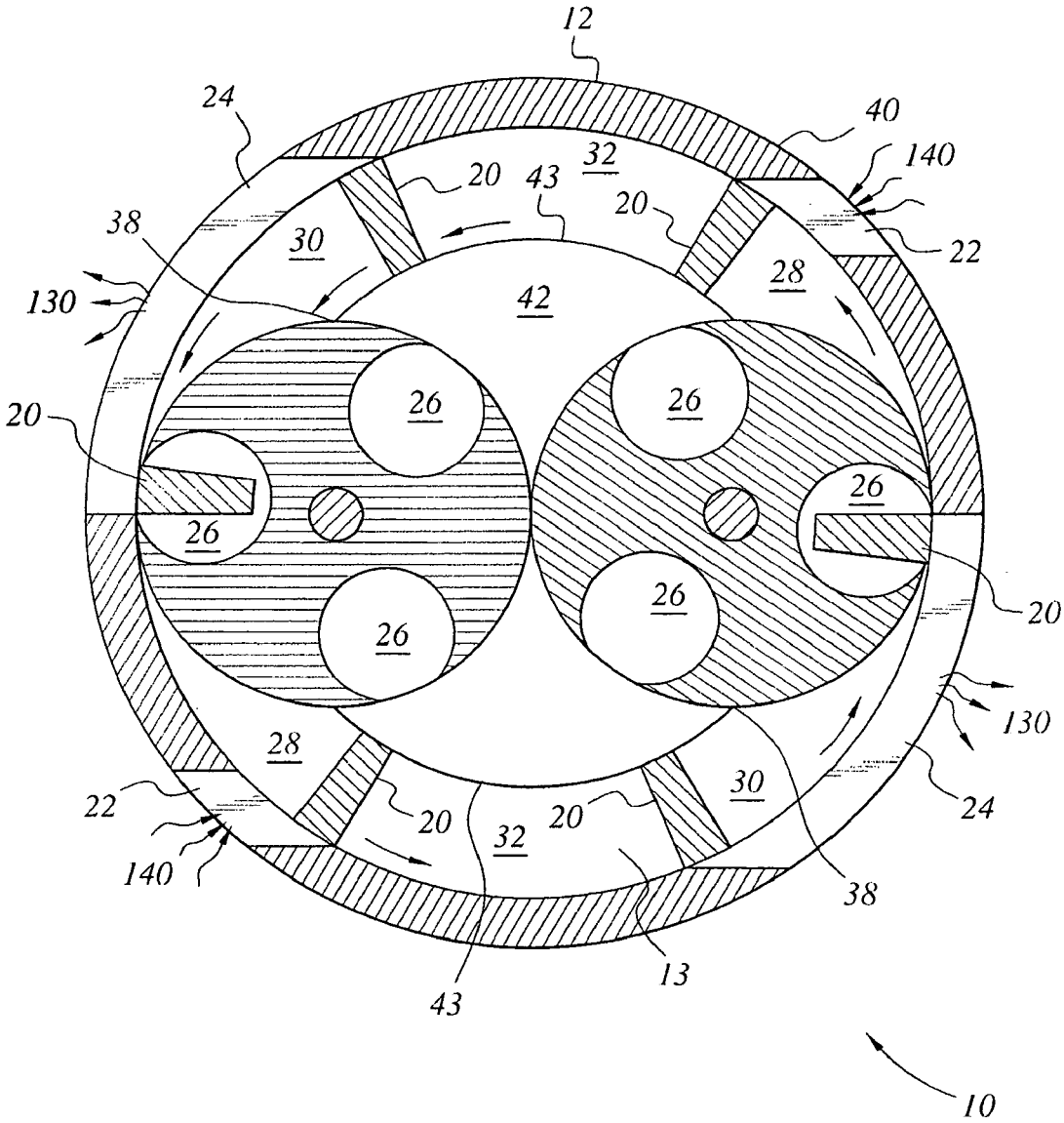
FIG. 2B is a transverse section view through the housing of a second embodiment of the rotary piston power system according to the present invention configured to act as an engine.

FIGS. 1, 2A and 2B illustrate a rotary piston power system 10, which may be configured as either a fluid-driven engine or a fluid compressor. FIG. 2A illustrates the system 10 being utilized as a fluid compressor and FIG. 2B illustrates the system 10 being utilized as a fluid-driven engine, as will be described in detail below. The system 10 includes a pair of rotary pistons 14 received within a housing that includes a drum or base member 12 and a cover 16 rotatably attached to the base member 12.

When configured as a compressor, as illustrated in FIG. 2A, a compressible fluid, such as a gas, enters the base 12 through low pressure ports 24 at a relatively low pressure and is compressed by the rotary pistons 14, thereafter being expelled or exhausted through high pressure ports 22 under a relatively high pressure, thus providing high pressure compressed fluid to be used as a driving force in a pressurized fluid-driven system.

The system 10 may alternatively be configured as a fluid-driven engine, shown in FIG. 2B, by reversing the rotation direction and the fluid flow; i.e., high pressure fluid is driven through high pressure ports 22, which impacts vanes 20 or causes a pressure differential in the chambers on opposite sides of the vanes 20 which, in turn, causes cover member 16 and pistons 14 to rotate, as will be described below. It should be noted that the fluid compressor of FIG. 2A includes high pressure input ports 22 which are angularly positioned closer to low pressure ports 24 than in the fluid-driven engine of FIG. 2B, the operational details of which will be described in further detail below.

Cover member 16 may have a shaft 18 projecting therefrom, which allows for either coupling of shaft 18 to a prime mover for driven rotation of cover member 16 when configured as a compressor, or allows coupling of shaft 18 to a load so that the rotation of cover member 16 is utilized as a rotational energy source when system 10 is configured as an engine.

Rotary pistons 14 and cover member 16 are the only moving parts of the system, thus minimizing the generation of unwanted noise, vibration and loss due to friction in the system. Additionally, as shown in FIG. 2B, when the system 10 is utilized as an fluid-driven engine, fluid under pressure is input under relatively high pressure (as shown by arrows 140) through high pressure ports 22 and output from system 10 through low pressure ports 24 (as shown by arrows 130). When system 10 is utilized as a compressor, shown in FIG. 2A, fluid under relatively low pressure is input into system 10 through low pressure ports 24 (shown by arrows 120), and output through high pressure ports 22 (shown by arrows 110). In FIG. 2A, both the cover 16 and pistons 14 rotate in a clockwise direction, and when fluid flow is reversed, as in FIG. 2B, the cover 16 and pistons 14 rotate in a counter-clockwise direction.

As shown in the drawings, base 12 is formed as a cylindrical shell or drum having a circular disk 13 and a peripheral wall 40 extending from the periphery of the disk 13, with the top end being open. Although base 12 may have any desired shape, it is preferable to form base 12 as a cylindrical shell for purposes of rotation, as will be described in further detail below. A pair of high pressure ports 22 and a pair of low pressure ports 24 are formed through the peripheral wall 40 of base 12. Although two of each type of port are shown in FIG. 1, any suitable number may be formed through the sidewall 40 of base member 12, depending on the needs of the user. It will be noted that the location of ports 22 and 24 relative to the pistons 14 is fixed, with one high pressure port 22 and one low pressure port 24 combination being disposed approximately every 180° in a dual piston system. The size and angular placement of the ports 22 and 24 varies, however, dependent upon whether the system 10 is configured as a compressor or an engine, as shown by comparison of the ports 22 and 24 in FIGS. 2A and 2B.

A separation member or separator wall 42 is formed in the interior of base member 12 and extends from disk 13. As shown in FIGS. 1, 2A and 2B, the separator wall 42 has arcuate, convex end faces 43 and a pair of semicylindrical recesses 38 defined in opposing sides of the separator wall 42. It should be noted that the configuration of separator wall 42 and end faces 43 are for exemplary purposes only and the exact curvature and spacing between elements in system 10 is dependent upon the needs of the user.

Axles 36 project from disk 13 within the opposing recesses 38, as shown in FIG. 1. Each rotary piston 14 has a bore 34 formed therethrough. Rotary pistons 14 are rotatably mounted on axles 36 with axles 36 extending through bores 34, the pistons 14 extending between the separator wall 42 and the peripheral wall 40 of base 12 with a close tolerance. A plurality of substantially cylindrical recesses 26 are formed in each piston 14, with the longitudinal axis of each recess 26 being parallel to bore 34. Each cylindrical recess 26 forms both an opening in an upper surface of the respective piston 14 and an slot 27 in the peripheral wall of the piston 14, with both the top openings and slots 27 being in communication with one another, as best shown in FIG. 1.

FIGS. 1, 2A and 2B show three recesses 26 being formed in each piston 14. However it should be understood that the number of recesses formed in each piston may be selected dependent upon the needs of the user. Recesses 26 are formed in the piston 14 at equal radial angles, e.g., the three recesses 26 are disposed 120° apart, defining a piston with three lobes. As will be discussed in further detail below, recesses 26 receive vanes 20 of cover 16. When configured as a compressor, rotation of cover 16 generates rotation of rotary pistons 14 through engagement of vanes 20 with slots 27 and recesses 26, and similarly, when fluid is charged into system 10, rotation of vanes 20 causes rotation of pistons 14 through the engagement between vanes 20 and recesses 26 when system 10 is configured as a fluid-driven engine.

As shown in the drawings, vanes 20 are mounted equiangularly from each other along a periphery of cover member 16. Vanes 20 extend radially inwardly from the circumference of cover member 16, and taper in thickness from wide to narrow as they extend inwardly. The taper of the vanes 20 enables smooth engagement with the edges of slots 27 in pistons 14 as the cover 16 rotates. Each vane 20 provides a fluid-tight seal with the corresponding slot 27 when vane 20 engages slot 27. The number of vanes 20 is twice the number of cylindrical recesses 26 defined in the pistons 14, so that each piston makes two full revolutions for each full revolution of the cover 16.

Cover member 16 is best shown in FIG. 1. The cover member 16 is shown as having a circular cross section, but any desired contour may be selected. The circular cross-sectional contour is preferable, as it is necessary for cover member 16 to form a fluid-tight seal with base member 12 and for cover member 16 to be rotatable with respect to base 12.

A shaft 18 is formed on a top surface of cover 16 and projects centrally therefrom. Shaft 18 is utilized to drive rotation of cover 16 with respect to base member 12 when system 10 is used as a fluid compression system by coupling shaft 18 to a prime mover. Alternatively, when system 10 is configured as a fluid-driven engine, cover 16 is made to rotate by the fluid input into system 10 under a relatively high pressure. This rotation drives shaft 18, allowing the rotational energy to be utilized by rotationally driven systems mechanically connected to shaft 18.

Projecting from a lower surface of cover 16 are a plurality of vanes 20. As shown in FIGS. 2A and 2B, vanes 20 each taper in thickness as they extend radially inward to form wedges, which engage and disengage recesses 26 of pistons 14 when cover 16 rotates with respect to base 12. The alternating engagement and disengagement of recesses 26 and vanes 20 allows for mechanically driven rotation of pistons 14 when system 10 is utilized as a fluid compressor, as will be further discussed below, and, similarly, the engagement and disengagement of recesses 26 and vanes 20 is produced in an opposite direction, creating reverse rotation, when the system is utilized as a fluid-driven engine (as illustrated in FIG. 2B). As shown in FIGS. 2A and 2B, vanes 20 have a length slightly less than the distance between peripheral wall 40 and the convex end walls 43 of separator wall 42, so that there is a close tolerance or seal between the vanes 20 and the separator wall 42 when the vanes 20 do not engage the slots 27 or cylindrical recesses 26 of pistons 14.

As shown in the embodiment of FIGS. 2A and 2B, six vanes 20 are provided. Although the number of vanes 20 is dependent on the desires and needs of the user, it is preferred that the number of vanes 20 be twice the number of recesses 26 formed in each rotary piston 14. This configuration produces optimal conditions for fluid compression and expulsion, since rotary pistons 14 will rotate at twice the angular velocity as cover member 16, which, in turn, produces optimal efficiency for the engine or compressor 10 and maintains both pistons 14 and cover 16 in close alignment, as will be further described below.

As may be apparent from inspection of FIGS. 2A and 2B, the cover 16 necessarily has an interior diameter that is equal to twice the diameter of one of the pistons 14. Thus, a one-half rotation of cover 16 will cause a full rotation of each piston 14. This one-to-two rotational correspondence ensures proper alignment of the three moving parts of the system (i.e., each recess 26 will always engage the same pair of vanes 20, spaced 180° apart from one another), increasing efficiency and reducing the chances of noise, vibration or frictional losses in the system.

In the drawings, system 10 is shown as having six vanes 20 mounted on cover member 16, with three recesses 26 formed in each piston 14. As described above, this is for exemplary purposes only, although it is desired that the number of vanes 20 be twice the number of recesses 26 formed in each rotary piston 14. In the exemplary configuration shown in the drawings, the vanes 20 are arranged at 60° increments about the periphery of cover member 16, with vanes 20 being positioned equiangularly from one another. Recesses 26 are positioned at 120° increments about the rotational axis of each piston 14. As described above, the 2:1 ratio of the number of vanes 20 with respect to the number of recesses 26 in each piston 14 acts as a 2:1 gear ratio. Further, as shown in FIGS. 2A and 2B, when one of vanes 20 engages a respective one of recesses 26, a fluid-tight seal is formed in the side opening of the recess 26.

In operation as a fluid compressor, as shown in FIG. 2A, which illustrates the rotor parts of FIG. 1 fully assembled, vanes 20 engage and disengage recesses 26 as cover 16 and pistons 14 rotate with respect to base 12. Each adjacent pair of vanes 20, together with the peripheral wall 40, separator end wall 43, disk 13, and cover 16, defines a compartment 28, 30, or 32. When system 10 is configured as a fluid compressor, fluid under a relatively low pressure enters base 12 through low pressure ports 24 and is contained initially in low pressure regions 30. Cover 16 is driven to rotate (clockwise in the example of FIG. 2A) through driven rotation of shaft 18, causing vanes 20 to alternately engage and disengage the recesses 26, which, in turn, causes pistons 14 to rotate, also in a clockwise direction, causing the lobes of the piston 14 to alternately enter compartments 28, 30 or 32, decreasing the volume and creating a region of high pressure fluid 28, which is discharged through high pressure ports 22. As shown in FIG. 2A, vanes 20 form a fluid-tight seal with separation member 42. As shown at the top and bottom of FIG. 2A, fluid is temporarily trapped between pairs of vanes 20, pistons 14 and the separation member 42, maintaining the fluid in this region at a constant pressure until the fluid is output through a corresponding output port.

As cover 16 and pistons 14 rotate, the fluid in high pressure regions 28 is compressed, increasing fluid pressure in these regions. Simultaneously, pressure in low pressure regions 30 is decreased, thus drawing more fluid through low pressure ports 24. High pressure fluid is expelled through high pressure ports 22, which may then be drawn off and used in a system requiring pressurized fluid.

Device 10 may also be used as a rotary motor or engine, as illustrated in FIG. 2B. In reversing the fluid flow, high pressure fluid is injected into system 10 through high pressure ports 22, which, in turn, causes a reverse rotation to that described above of cover member 16 and rotary pistons 14. As described above, the high pressure ports 22 in the configuration of FIG. 2A are angularly positioned closer to low pressure ports 24 than in the engine configuration of FIG. 2B, but both the high pressure 22 and low pressure 24 ports are larger in size when the system 10 is configured as an engine. The rule is that the position of the ports 22 and 24 is designed so that no compartment 28, 30 or 32 is open to two ports 22 and 24 at any time. Fluid is released through low pressure ports 24 and may be driven back through high pressure ports 22. Subsequent rotation of cover 16 creates rotation in shaft 18, which may be used to drive a rotary system. The engagement and disengagement of vanes 20 with the pistons 14 is similar to that described above with respect to FIG. 2A, however, the rotation of the moving parts is now reversed (as illustrated by the directional arrows).

The smooth continuous rotation of the elements of system 10 provides for a high-efficiency motor or compressor, which reduces noise and vibration and can be operated in a fuel-efficient manner. Further, forces act along the axes of the moving parts, thus reducing friction within the system. Only the cover member 16 and the rotary pistons 14 act as moving parts, thus minimizing the generation of unwanted noise, vibration and frictional loss. Frictional loss may further be minimized through the addition of a suitable lubricant between the moving parts. The smooth, continuous curvature of the pistons 14, base 12, separator wall 42, and cover 16 are economical to produce and reduce wear, providing durability of the parts.

It is to be understood that the present invention is not limited to the embodiments described above, but encompasses any and all embodiments within the scope of the following claims.

We claim:

1. A rotary piston power system, comprising:

a housing having a drum-shaped base and a cover rotatably disposed on the base, the housing defining a cavity;

a separator wall disposed within the housing, the separator wall defining a plurality of symmetrically disposed piston compartments;

a rotary piston mounted for rotation within each of the piston compartments, each of the pistons having a plurality of radially disposed slots and vane-receiving recesses defined therein, each of the pistons extending between the base and the separator wall with a close tolerance therebetween;

a plurality of radially disposed vanes extending from the cover into the cavity, adjacent pairs of the vanes defining fluid chambers therebetween, the vanes extending through the plurality of radially disposed slots into the vane-receiving recesses for coaction between the pistons and the cover when the cover rotates, the vanes and the slots being angularly spaced in a ratio so that the pistons have an angular velocity twice the angular velocity of the cover;

a plurality of high pressure ports and a plurality of low pressure ports symmetrically disposed in the drum-shaped base; and means extending from the cover for attachment to a load when the system is configured as a rotary engine and for attachment to a prime mover when the system is configured as a compressor.

2. The rotary piston power system according to claim 1, wherein said pistons are cylindrical and said piston compartments are semicylindrical.

3. The rotary piston power system according to claim 1, wherein said plurality of piston compartments consists of two compartments.

4. The rotary piston power system according to claim 3, wherein said plurality of slots and vane-receiving compartments consists of three slots and vane-receiving compartments radially separated by 120°, defining three-lobed pistons.

5. The rotary piston power system according to claim 4, wherein said plurality of vanes consists of six vanes radially separated by 60°.

6. The rotary piston power system according to claim 1, wherein said means extending from said cover comprises a shaft.

7. The rotary piston power system according to claim 1, wherein said separator wall comprises opposing convex end faces and a pair of semicylindrical recesses defined in opposing sides of the separator wall, said vanes bearing against the end faces of said separator wall when not engaging the slots and vane-receiving recesses.

8. The rotary piston power system according to claim 1, wherein the vane-receiving recesses are cylindrical in shape.

9. A rotary piston power system, comprising:

a pair of rotary pistons, each said rotary piston having a cylindrical body and a plurality of substantially cylindrical recesses formed therein, each said substantially cylindrical recess extending along a longitudinal axis parallel to a longitudinal axis of said rotary piston, each said substantially cylindrical recess defining an upper opening in an upper surface of said rotary piston and a slot in a sidewall of said rotary piston, the slots being equiangularly spaced about the piston sidewall;

a disk and a peripheral wall extending normal to the disk defining a base member having an open end opposite the disk, said base member defining a central cavity, the peripheral wall having at least one high pressure port and at least one low pressure port defined therein;

a separator wall formed in the central cavity defined by said base member, said separator wall having opposing convex end faces and a pair of semicylindrical recesses defined in opposing sides thereof;

a pair of axles extending from the disk, one of the axles being disposed in each of the semicylindrical recesses, respectively, the pistons being rotatably mounted on the axles and extending between the separator wall and the peripheral wall of the base member; and a planar cover rotatably disposed over the open end of said base member and sealing the central cavity defined in said base member, said cover having a plurality of equiangularly spaced vanes extending radially inward on one face thereof, said plurality of vanes being received within said central cavity, adjacent pairs of the vanes defining a chamber therebetween, the vanes entering and exiting the cylindrical recesses through the slots in the pistons as the cover rotates and abutting the end faces of the separator wall when not extending through the slots;

whereby a fluid entering the high pressure port impacts the vanes to rotate the cover when the system is configured to operate as an engine, said rotating pistons alternately expanding and contracting the volume of the chambers to compress a fluid entering the low pressure port and expel the compressed fluid when the system is configured as a compressor.

10. The rotary piston power system as recited in claim 9, wherein the number of said plurality of vanes is twice the number of said plurality of substantially cylindrical recesses of each said rotary piston, whereby each said piston completes two revolutions for each revolution of said cover.

11. The rotary piston power system as recited in claim 10, wherein the equiangular spacing between the cylindrical recesses defined in each said spacing is twice the equiangular spacing of said vanes, whereby the angular velocity of said cover member is one-half the angular velocity of each said rotary piston.

12. The rotary piston power system as recited in claim 9, wherein said cover comprises a circular plate.

13. The rotary piston power system as recited in claim 9, wherein said cover further comprises a shaft extending from the face opposite the vanes.

14. The rotary piston power system according to claim 13, further comprising a prime mover coupled to said shaft for rotating said cover, whereby the system is configured as a compressor.

15. The rotary piston power system according to claim 13, further comprising a load coupled to said shaft, whereby the system is configured as a rotary engine.

16. The rotary piston power system as recited in claim 9, wherein each of said vanes tapers in thickness from wide to narrow extending radially inward from a periphery of said cover.

17. The rotary piston power system as recited in claim 9, wherein said plurality of cylindrical recesses consists of three recesses defining a three-lobed piston, and said plurality of vanes comprises six vanes defining six chambers.

18. The rotary piston power system according to claim 9, wherein said at least one low pressure port and said at least one high pressure port comprises a pair of low pressure ports disposed 180° apart and a pair of high pressure ports disposed 180° apart.

* * * * *